US005720614A

United States Patent [19]

Pestano

[11] Patent Number: 5,720,614

[45] Date of Patent: Feb. 24, 1998

[54] STRUCTURE MODELING MEMBERS FOR SAND FIGURES

[76] Inventor: Domingo Pestano, 4460 NW. 74 Ave., Miami, Fla. 33166

[21] Appl. No.: 619,292

[22] Filed: Mar. 18, 1996

[51] Int. Cl.[6] ..... G09B 25/00

[52] U.S. Cl. ..... 434/82; 446/70

[58] Field of Search ..... 434/82; 446/128, 446/85, 70

[56] References Cited

U.S. PATENT DOCUMENTS

| | | | |
|---|---|---|---|
| 1,210,354 | 12/1916 | Noyes | 434/82 |
| 2,545,210 | 3/1951 | Moore | 434/82 |
| 3,055,119 | 9/1962 | McEween | 434/82 |
| 3,064,365 | 11/1962 | Ganine | 434/82 |
| 3,503,832 | 3/1970 | Ummingar, Jr. | 434/82 |
| 4,674,981 | 6/1987 | LaPadura | 434/82 |
| 5,174,757 | 12/1992 | Jones | 434/82 |
| 5,460,561 | 10/1995 | Dahlgren | 446/70 |

FOREIGN PATENT DOCUMENTS

| | | | |
|---|---|---|---|
| 1401619 | 7/1975 | United Kingdom | 434/82 |

OTHER PUBLICATIONS

Magic Castle Molds, "Playthings", Feb. 1981.

*Primary Examiner*—Paul J. Hirsch
*Attorney, Agent, or Firm*—J. Sanchelima

[57] ABSTRACT

A structure modeling device for the creation of sand figures, including sand castles, that provide structural stability to the resulting figures and aesthetic enhancement. The main structural member includes a central body member and at least two fin members extending outwardly therefrom at an angle so that sand is cooperatively received and its weight directed downwardly to enhance the interlocking engagement with abutting members. Other structural members permit a user to form diverse building shapes, such as columns or cones. All of these members have fin members that hold sand or other granular material and direct its weight downwardly through the engagement means in order to enhance the stability of the resulting figure or structure.

11 Claims, 5 Drawing Sheets

STRUCTURE MODELING MEMBERS FOR SAND FIGURES

BACKGROUND OF THE INVENTION

1. Field of the Invention

The present invention relates to a structure modeling device for molding and building different structural figures with sand, or other granular bodies.

2. Description of the Related Art

Numerous mold structures have been used to make decorations with sand, typically sand castles at beaches. However, none of the structures that exist today include the features disclosed in the present invention. For example, the use of fins extending at an angle from a central structural member provides a cooperative receiving member for the sand that also directs the inherent gravitational force downwardly to further enhance the stability of the mold structures.

One of the closest references corresponds to U.S. Pat. No. 3,064,365 issued to Ganine and entitled "Modeling Device". While providing for a number of articulated members that permits a user to mold pieces with precision, the border of supporting the entire structure falls on the articulated joints. There is no teaching of holding a granular body to direct its weight downwardly to enhance the structural stability of the device.

SUMMARY OF THE INVENTION

It is one of the objects of the present invention is to provide structural members that interconnect with each other to permit a user to mold sand in different shapes.

It is another object of this invention to provide structural members that include cooperative members to hold the sand and direct its weight downwardly through a central structural member.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1A:
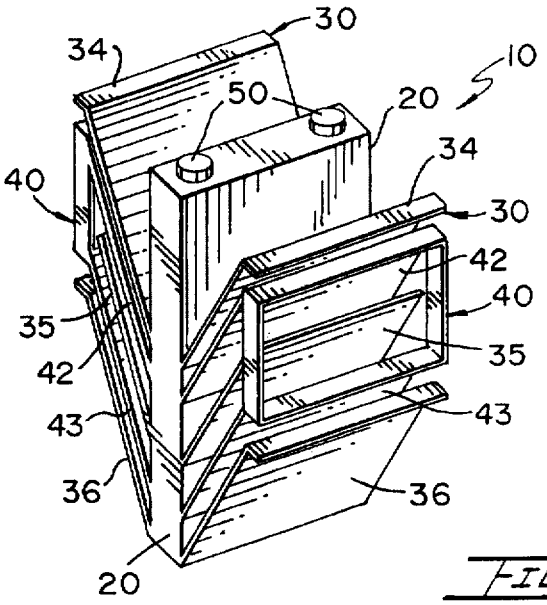
FIG. 1A represents an isometric view of one of the embodiments for the present invention.

The present invention discloses a group of structural components or members that, interconnected to each other create several and different structures. These structures are filled with a granular material, such as sand, forming buildings, castles, etc. A user can achieve precision while maintaining the structural stability of the resulting work.

Referring now to the drawings, one of these structural members, subject of the present invention, is referred to with numeral 10 in FIGS. 1A through 1D, it can be observed that it basically includes upright central body member 20, fin assemblies 30, frames 40, male engagement pins 50 and female engagement openings 60.

Structural member 10 includes upright central body member 20 to which a plurality of fin members 34; 35 and 36 are mounted, at an angle, on both sides. Central body member 20 has a substantially rectangular shape. Fin assembly 30 is designed to hold sand and distal edges of fin members 34; 35 and 36 are preferably aligned to allow for the molding of smooth surfaces of sand.

Figure 1B:
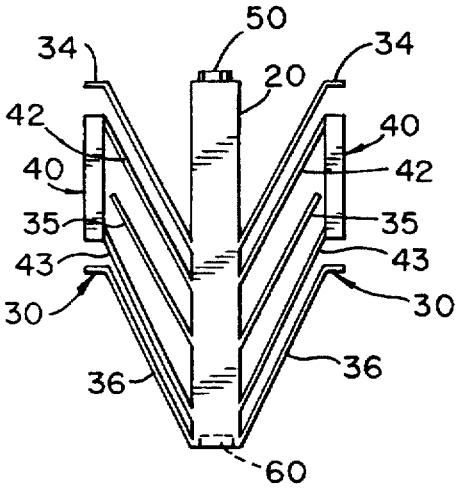
FIG. 1B is an elevational front view of the embodiment shown in the previous figure.
Figure 1C:
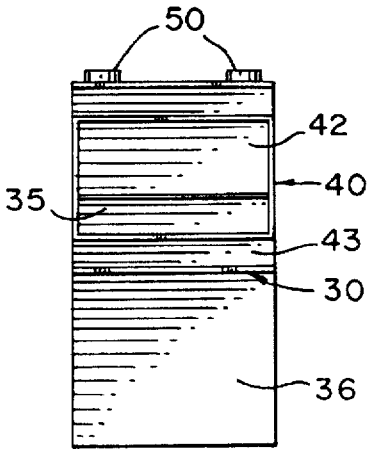
FIG. 1C shows an elevational side view of this invention.
Figure 1D:
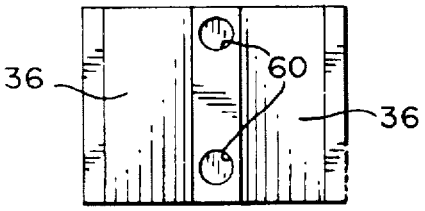
FIG. 1D is a bottom view of this invention.
Figure 2A:
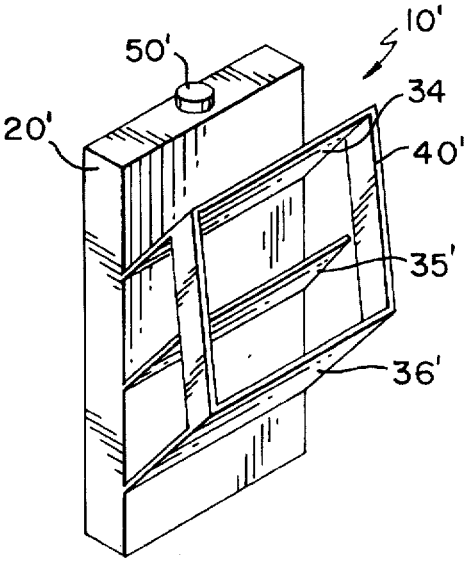
FIG. 2A represents an isometric view of another embodiment for one of the components of the present invention.
Figure 2B:
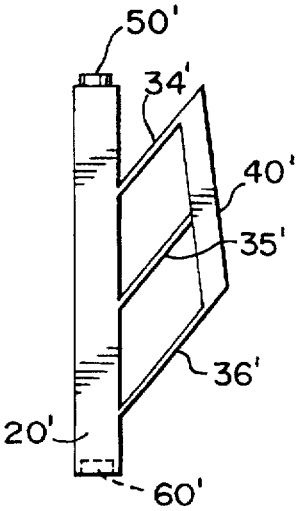
FIG. 2B is an elevational front view of the embodiment shown in FIG. 2A.
Figure 2C:
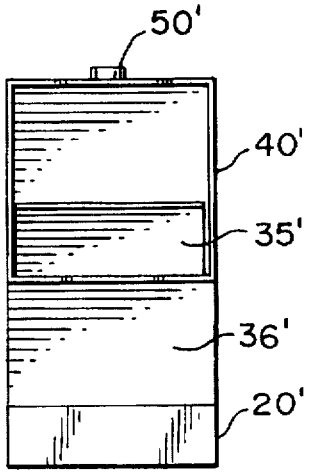
FIG. 2C is an elevational side view of the embodiment shown in FIG. 2A.
Figure 2D:
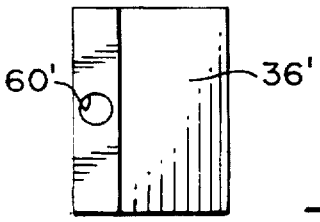
FIG. 2D is a bottom view of the embodiment shown in FIG. 2A.
Figure 3A:
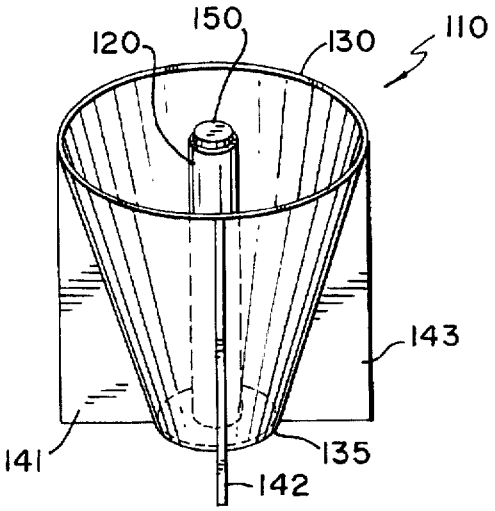
FIG. 3A represents an isometric view of another component showing a conical shape alternative for the present invention to be used to mold round surfaces.
Figure 3C:
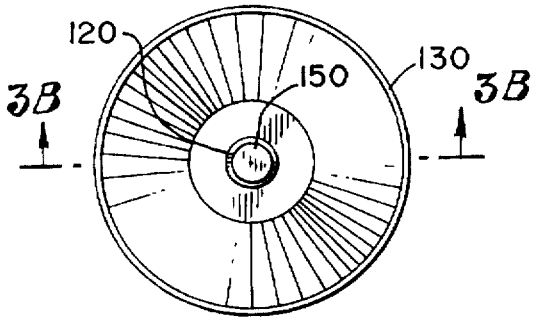
FIG. 3C is a top view of the embodiment shown in FIG. 3A.
Figure 3B:
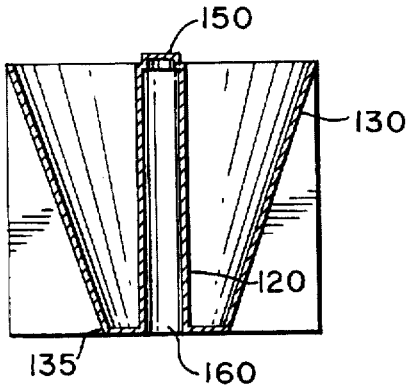
FIG. 3B is an elevational cross section view of the embodiment shown in FIG. 3C taken along line 3B—3B.
Figure 3D:
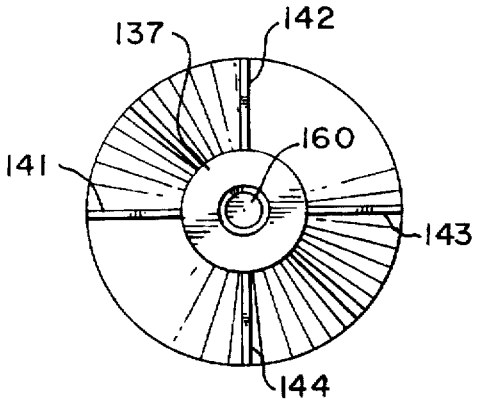
FIG. 3D is a bottom view of the embodiment shown in FIG. 3A.

Frame 40 is mounted to central body 20 by supporting fin members 42 and 43. Frame 40 is used to enhance the decorative function of the molded work, as best seen in FIGS. 1A and 1B. It is intended to simulate the outer look of a block or brick in a building structure, specially after it is covered with sand.

Male engagement pins 50 and female engagement openings 60 are designed to permit the removable engagement of contiguous structural members 10 when joined together to form a wall or other building structures. Members 10 can also include other interlocking configurations, for instance, pin 50 can have a non-circular cross-section with a cooperating non-circular engagement opening 60.

In essence, the present modeling device is intended to shape and hold sand, and permit a user more latitude in the creation of three-dimensional shapes with sand, while simulating the use of blocks or bricks to enhance the aesthetic appeal of the resulting figure or structure.

In FIGS. 2A through 2D, an alternate embodiment is shown and referred to with numeral 10', wherein fin members 34'; 35' and 36' are mounted, an angle, to central body member 20'. In contrast with structural member 10, frame 40' is slanted with respect to central body member 20'. Male engagement pin 50' and female engagement opening 60' function like pin 50 and opening 60 in structural member 10. As stated above, other interconnecting means can also be used.

Frustroconical structural member 110 is shown in FIGS. 3A through 3D and it also includes male engagement pin 150 and cooperating female engagement opening 160. A continuous frustroconical wall 130 has narrow end 135 with circular base 137 on which, and perpendicularly thereto, centrally disposed tubular member 120 is mounted. At the uppermost end of tubular member 120, engagement pin 150 is formed.

Frustroconical structural member 110 has corner walls 141; 142; 143 and 144 that extend radially outwardly. When covered with sand bringing an outer cylindrical configuration.

FIGS. 4A through 4D show rectangular structural member 210 used in combination with structural members 10 and 10' to provide a structural termination for the latter. Outwardly extending walls 212; 214; 216 and 218 are joined or connected to each other and all commonly connected through rectangular base member 219. Rectangular base member 219 and four wall members 212; 214; 216 and 218 extending upwardly and outwardly from base member 219 form an angled rectangular frame. Rectangular structural member 210 also includes four corner walls 231; 232; 233 and 234 mounted at the corners of the angled frame so that the end projection of structural member 210 has a rectangular shape. Rectangular structural member 210, also includes four laterally disposed fin members 235; 236; 237 and 238 to hold sand in the cavities formed between the formers and walls 212; 214; 216 and 218, respectively. Tubular member 220 is rigidly mounted to base member 219 with an engagement mechanism located at its both ends. Male engagement pin 250 removably engages female engagement opening 260 of similar rectangular structural members.

Figure 6:
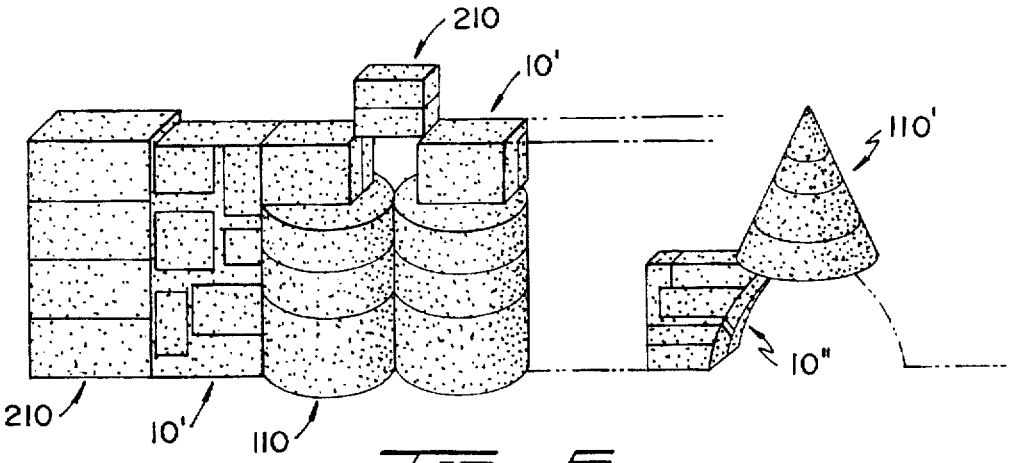
FIG. 6 illustrates an application of the present invention, showing the previous figure filled with sand.
Figure 4A:
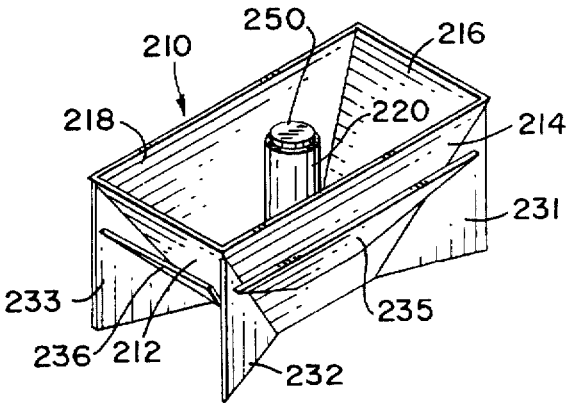
FIG. 4A represents an isometric view of another embodiment showing a rectangular component used in the present invention to form the corners of the structures to be molded.
Figure 4C:
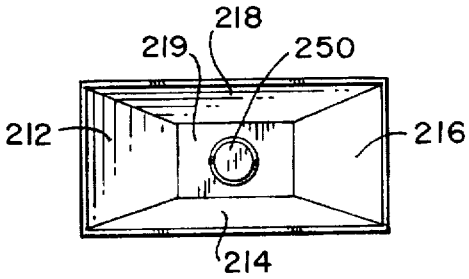
FIG. 4C is a top view of the embodiment shown in FIG. 4A.
Figure 4B:
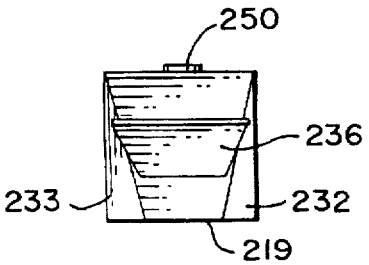
FIG. 4B is an elevational side view of the embodiment shown in FIG. 4A.
Figure 4D:
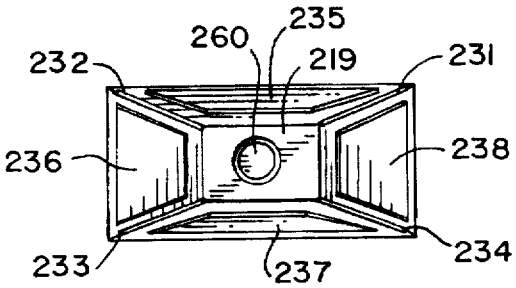
FIG. 4D is a bottom view of the embodiment shown in FIG. 4A.
Figure 5:
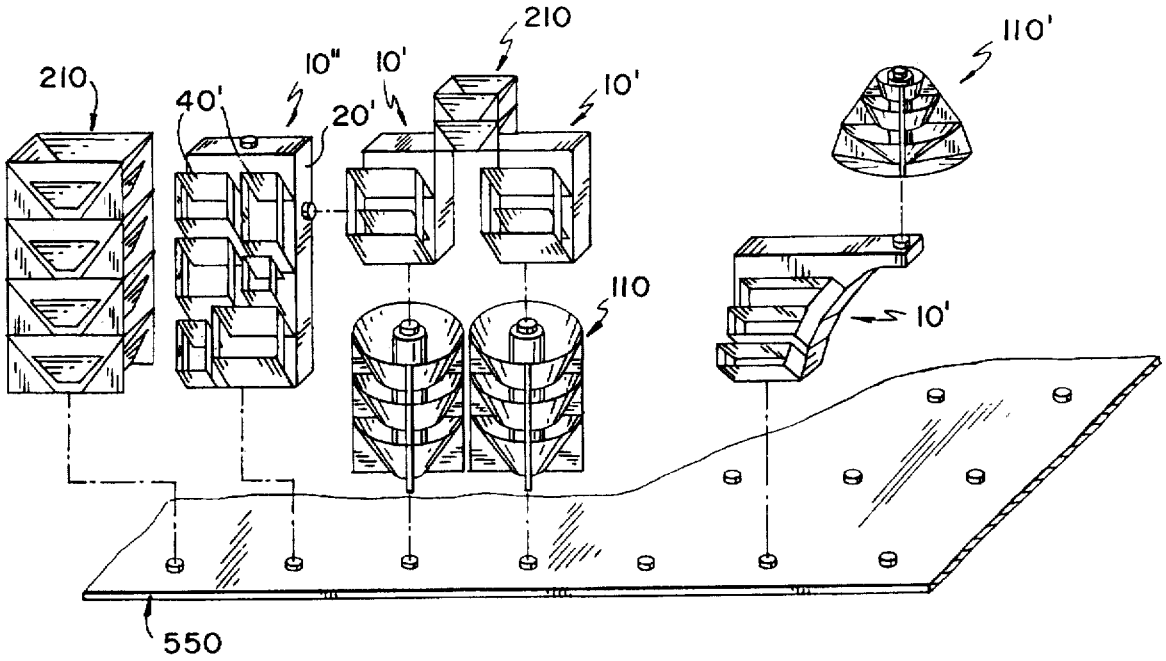
FIG. 5 illustrates a combination of different alternatives shown in the previous figures being mounted on a supporting base.

As shown in FIGS. 5 and 6, a modification of embodiment 110 can be made to allow a user to mold conical structures or shapes. Frustroconical structural member 110' has the angular inclination of frustroconical wall 130 (of member 110) different from among different cooperating structural members 110 so that when interconnected and filled with sand a conical body results.

In FIG. 5, members 10; 10'; 10"; 110; 110' and 210 are used. Structural member 10" is a variation of member 10' with several frame members 40' mounted to central body member 20' to aesthetically represent the contour of bricks or blocks. Similarly, structural member 110' is a variation of structural member 110 showing how the present invention can be modified to accommodate a user's requirements. These structural members with different shapes are removably mounted to platform assembly 550. Finally, in FIG. 6 structural members 10; 10'; 10"; 110; 110' and 210 and are illustrated filled with sand creating a building structure molded.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

I claim:

1. A structure modeling device for sand figures with a granular material, comprising:

a plurality of first structural members having each a central body member with top, bottom, front, back and two side surfaces, and said top and bottom surfaces further including each of said structural members mating connecting means for removably interlocking said first structural members to each other, said first structural members including each of said structural members first and second fin members mounted to said front surface, in parallel disposition with respect to each other, and said first and second fin members having each first and second ends, said first ends being rigidly mounted to said central body member and said fin members extending outwardly from said central body member at an angle, and a first frame member mounted at said second ends of said first and second fin members and suspended at a spaced apart relationship with respect to said central body member so that the sand is held by said fin members and structural figures can be formed with the cooperative combination of said first structural members.

2. The structure modeling device set forth in claim 1 wherein said central body member is flat.

3. The structure modeling device set forth in claim 2 further including third and fourth fin members mounted to said back surface in parallel disposition with respect to each other, and said third and fourth fin members having each first and second ends, said first ends being rigidly mounted to said central body member and said third and fourth fin members extending outwardly from said central body member at an angle, and a second frame member mounted at said second ends of said third and fourth fin members and suspended at a spaced apart relationship with respect to said central body member.

4. The structure modeling device set forth in claim 3 further including:

B) a plurality of second structural members having each a rectangular base member and four wall members extending upwardly and outwardly from said base member forming an angled frame and four corner walls mounted at the corners of said angled frame so that the end projection of said second molding members has a rectangular shape, and further including a cylinder member centrally mounted to said base and coaxially disposed within said angled frame, and said cylinder member having an upper and a lower end with complementing mating connecting means, and said lower end protruding through said base, and further including at least one lateral fin member mounted to at least one of said walls and extending upwardly at an angle with respect to the wall member where said fin member is mounted on, and said plurality of second structural members having cooperative dimensions to match the ends of said first structural members, and said second structural members further including connecting means for removably engaging said second molding means to other first and second structural members so that figures can be formed.

5. The structure modeling device set forth in claim 4 further including:

a plurality of third structural members having each a circular base member with a frustroconical wall extending therefrom at an angle, and said third structural members further including a centrally disposed rod mounted thereon, and said rod having upper and lower ends that include mating connecting means for removably engaging with other first, second and third structural members having cooperatively mating connecting means so that figures can be formed.

6. The structure modeling device set forth in claim 5 wherein the angular inclination of said frustroconical wall is different from among different cooperating third structural members so that when interconnected and filled with sand a conical body results.

7. The structure modeling device set forth in claim 6 wherein said first structural members include a fifth fin member mounted to said front surface, in parallel disposition with respect to, and between, said first and second fin member, and said fifth fin member includes first and second ends, said first end being rigidly mounted to said central body member and said fifth fin member extending outwardly from said central body member at an angle.

8. The structure modeling device set forth in claim 2 wherein each of said first structural members further include third and fourth fin members mounted to said back surface in parallel disposition with respect to each other, and said third and fourth fin members having each first and second ends, said first ends being rigidly mounted to said central body member and said third and fourth fin members extending outwardly from said central body member at an angle.

9. The structure modeling device set forth in claim 8 further including:

B) a plurality of second structural members having each a rectangular base member and four wall members extending upwardly and outwardly from said base member forming an angled frame and four corner walls mounted at the corners of said angled frame so that the end projection of said second structural members has a rectangular shape, and further including a cylinder member centrally mounted to said base, and said cylinder member having an upper and a lower end with complementing mating connecting means, and said lower end protruding through said base, and further including at least one fin member mounted to at least one of said walls and extending upwardly at an angle with respect to the wall member where said fin member is mounted on, and said plurality of second structural members having cooperative dimensions to match the ends of said first structural members, and said second structural members further including connecting means for removably engaging said second structural means to other first and second structural members so that figures can be formed.

10. The structure modeling device set forth in claim 9 further including:

c) a plurality of third structural members having each a circular base member with a frustroconical wall extending therefrom at an angle, and said third structural members further including a centrally disposed rod mounted thereon, and said rod having upper and lower ends that include mating connecting means for removably engaging with other first, second and third structural members having cooperatively mating connecting means so that figures can be formed.

11. The structure modeling device set forth in claim 10 wherein the angular inclination of said frustroconical wall is different from among different cooperating third structural members so that when interconnected and filled with sand a conical body results.

* * * * *